US009237832B2

(12) United States Patent
Schlapkohl

(10) Patent No.: US 9,237,832 B2
(45) Date of Patent: Jan. 19, 2016

(54) ILLUMINATED INLET FOR VACUUM CLEANING APPARATUS

(71) Applicant: IVD Global Corporation, Palm City, FL (US)

(72) Inventor: Peter Schlapkohl, Jupiter, FL (US)

(73) Assignee: IVD Global Corporation, Palm City, FL (US)

( * ) Notice: Subject to any disclaimer, the term of this patent is extended or adjusted under 35 U.S.C. 154(b) by 482 days.

(21) Appl. No.: 13/762,122

(22) Filed: Feb. 7, 2013

(65) Prior Publication Data

US 2013/0318738 A1 Dec. 5, 2013

Related U.S. Application Data

(63) Continuation-in-part of application No. 13/485,313, filed on May 31, 2012.

(51) Int. Cl.

| | |
|---|---|
| ***A47L 5/38*** | (2006.01) |
| ***A47L 9/02*** | (2006.01) |
| ***A47L 7/00*** | (2006.01) |

(52) U.S. Cl.

CPC ..... *A47L 9/02* (2013.01); *A47L 7/0047* (2013.01); *A47L 5/38* (2013.01)

(58) Field of Classification Search

CPC ..... A47L 9/02; A47L 7/0047; A47L 5/38
USPC ..... 15/301, 312.1, 312.2, 314
IPC ..... A47L 5/38
See application file for complete search history.

(56) References Cited

U.S. PATENT DOCUMENTS

| | | | | |
|---|---|---|---|---|
| 2,675,273 | A | 4/1954 | Sanders | |
| 3,027,587 | A | 4/1962 | Bierstock | |
| 3,027,588 | A | 4/1962 | Bierstock | |
| 3,283,093 | A * | 11/1966 | Bishop | A47L 5/38 137/360 |
| 3,655,927 | A | 4/1972 | Samuelson et al. | |
| 3,783,472 | A | 1/1974 | Mol | |
| 4,336,427 | A | 6/1982 | Lindsay | |
| 4,617,034 | A | 10/1986 | Ikezaki et al. | |

(Continued)

FOREIGN PATENT DOCUMENTS

| | | |
|---|---|---|
| EP | 0165908 | 12/1985 |
| EP | 0461443 | 12/1991 |

(Continued)

*Primary Examiner* — David Redding
(74) *Attorney, Agent, or Firm* — McHale & Slavin, P.A.

(57) ABSTRACT

An illuminated inlet for a vacuum cleaning system which can be mounted in a wall of a structure or in a cabinet. The inlet includes a main frame, a front plate, a door, and an electrical switch that operates the motor of the vacuum cleaning system. Illumination of the area directly in front of the inlet is provided by LED's operated upon the opening of the door. The inlet is mounted adjacent a floor so that an individual can clean a room by sweeping up the dirt and debris towards the present invention. The door of the inlet is then opened and the dirt and debris is swept into the present invention. When the door opens the LED's are illuminated and the motor of the vacuum cleaning system is turned on so that the dirt and debris can be drawn into a collection container. When the door is closed, the LED's and the motor for the vacuum cleaning system is turned off. A magnet is used to keep the door in the open position and a retainer to keep the door in the closed position.

10 Claims, 13 Drawing Sheets

(56) References Cited

U.S. PATENT DOCUMENTS

| | | | | |
|---|---|---|---|---|
| 4,938,309 | A | 7/1990 | Emdy | |
| 4,970,753 | A | 11/1990 | Herron, Jr. | |
| 5,279,016 | A | 1/1994 | Klassen | |
| 5,293,664 | A | 3/1994 | Lim et al. | |
| 5,408,721 | A | 4/1995 | Wall et al. | |
| 5,504,967 | A | 4/1996 | Graham | |
| 6,108,858 | A | 8/2000 | Smith | |
| 6,158,080 | A | 12/2000 | Schlapkohl | |
| 6,292,977 | B1 | 9/2001 | Mantyla et al. | |
| 6,530,116 | B2 | 3/2003 | Berfield et al. | |
| 6,856,113 | B1 * | 2/2005 | Cunningham | A47L 5/38 15/314 |
| 7,581,281 | B2 | 9/2009 | Schlapkohl | |
| 2007/0283521 | A1 * | 12/2007 | Foster | A47L 5/38 15/314 |

FOREIGN PATENT DOCUMENTS

| | | |
|---|---|---|
| JP | 147039 | 6/1990 |
| WO | WO2006096309 | 9/2006 |

* cited by examiner

ILLUMINATED INLET FOR VACUUM CLEANING APPARATUS

RELATED APPLICATION

In accordance with 37 C.F.R. 1.76, a claim of priority is included in an Application Data Sheet filed concurrently herewith. Accordingly, under 35 U.S.C. §119(e), 120, 121, and/or 365(c) the present invention claims priority, as a continuation-in-part of U.S. patent application Ser. No. 13/485,313, entitled "Inlet for Vacuum Cleaning Apparatus", filed May 31, 2012, the contents of which is incorporated herein by reference.

FIELD OF THE INVENTION

The present invention relates generally to the field of vacuum cleaning devices. More specifically, central vacuum cleaning systems. In particular, the invention is an inlet for a vacuum cleaning system. The inlet can be permanently mounted adjacent the floor of a room so the dust and debris swept from the floor can be sent into the vacuum cleaning system through the inlet. When the inlet is opened it activates the central vacuum system and illuminates the area directly in front of the inlet. When the inlet is closed it shuts off the vacuum cleaning system, thereby saving the operator the need to separately turn on and off the vacuum cleaning system.

BACKGROUND OF THE INVENTION

Central vacuum cleaning systems are useful in homes, offices and commercial establishments. These systems generally utilize a unitary centrally located station containing a vacuum supply, a collection receptacle and a plurality of conduits which interconnect various parts of the structure to the central station. The conduits normally terminate in a hose adapter coupling enabling each area to be cleaned by inserting the hose assembly into the hose coupling and activating the central station vacuum supply. The hose assembly is normally moved from one room to another. In some systems the hose coupling also supplies electrical power to a brushing system, sometimes referred to as a powerhead.

These systems suffer from the fact that an extremely powerful unit must be utilized in order to compensate for the pressure drop experienced in traversing the various heights and bends needed to route the conduit through the walls of the structure. Furthermore, prior art central vacuum systems have historically been limited to inclusion in only new construction since it is both difficult and costly to install the necessary conduits in existing structures.

In addition, as the air filtering and residue collecting receptacle becomes filled, there is a tendency for the airflow around it to be impaired as it presses against the inner walls of its housing. The instant invention incorporates a unique baffle assembly which advantageously lines the inner walls of the housing around the collection receptacle and maintains an unimpeded flow path so as to insure optimum operation, even as the receptacle becomes filled.

Wall recessed cleaning systems are known that are self-contained so as to include the vacuum supply, vacuum bag and hose receptacle in a single unit, adapted to be situated within an opening prepared in the wall of an existing structure. The problem with such prior art devices was that they were difficult to install within an interior wall recess since they were greater than 6 inches in depth. Another problem was that the geometry of the motor structure necessitated use of an inefficient flow pattern in order to reduce the unit's overall dimensions.

DESCRIPTION OF THE PRIOR ART

U.S. Pat. No. 5,504,967 discloses a combined inlet structure and switching device for a central vacuum system which includes an inlet housing having top, bottom and side walls defining a vacuum inlet chamber and a front with a dirt receiving opening. An aperture located in the top wall and can be connected to a pipe leading to a central vacuum source. A closure member is movable between first and second positions in order to close or open the aperture. A foot operated actuator is connected to the housing and is able to pivot the closure member between the first and second positions. A spring biases the closure member towards the first position and operates when the actuator is pressed in one direction. When the closure member is moved to the second position, it will remain there unless the actuator is pressed in another, opposite direction. There is also a switch mechanism responsive to movement of the actuator for opening and closing an electrical circuit connected to the central vacuum source.

U.S. Pat. No. 5,279,016 discloses a suction inlet for a central vacuum system of a building which includes a housing mounted on the floor of the building thereby defining a slot along the floor. The slot can be opened and closed and simultaneously a vacuum duct connected to the housing is opened and closed by a plug member. When the plug and the slot are opened, a switch actuates the central vacuum system to draw air into the housing through the slot across the floor so that dust, dirt and debris on the floor can simply be swept into the slot and drawn away.

U.S. Pat. No. 6,292,977 discloses a vacuum fitting for connection to a remote source of vacuum, such as a central vacuum system. The vacuum fitting comprising a main body mountable to a fixed structure. The main body includes an inlet opening and an outlet opening; an openable closure is mounted to the main body and is moveable between an open position and position covering the inlet opening; a latch member is selectively positionable to keep the closure in said covering position when positioned between the main body and the closure and to permit said closure to move to an open position when not positioned between said main body and the closure; and a biaser to urge the closure to an open position. A switch is also provided to initiate the remote source of vacuum, such as a central vacuum system, when the closure is moved to the open position by the biaser.

U.S. Pat. No. 6,158,080 discloses improvements in the operation and design of wall-mounted recessed vacuum cleaner systems. The disclosed invention incorporates an extremely compact motor design which enables the filtering debris receptacle to be arranged directly over the motor housing. The vacuum system of the disclosed invention includes an upper containment compartment and a lower evacuation compartment. The containment compartment houses an air filtering and residue collecting receptacle, e.g. a vacuum bag assembly, which may incorporate HEPA filtration characteristics.

U.S. Pat. No. 7,580,281, issued to the inventor of the present invention, discloses an improved wall-mounted recessed vacuum cleaner system which incorporates vibration dampening mounts between the motor and the outer housing, air channels within the housing to smooth air flow and reduced number of parts to significantly reduce the noise level during operation. The vacuum cleaner system incorporates an extremely compact housing and motor design with a filtering debris receptacle arranged directly over the motor compartment.

SUMMARY OF THE INVENTION

The present invention includes an illuminated inlet for a vacuum cleaning system which can be mounted in a wall of a structure, building, recreational vehicle, mobile home or in a cabinet. The inlet includes a main frame, a front plate, a door, and an electrical switch that operates the motor of the vacuum cleaning system. The inlet is mounted adjacent a floor so that an individual can clean a room by sweeping up the dirt and debris towards the present invention. The door of the inlet is then opened and the dirt and debris is swept into the present invention. When the door opens the motor of the vacuum cleaning system is turned on so that the dirt and debris is drawn into a collection container. The area directly in front of the inlet is illuminated allowing the operator ample lighting to assure all dirt and debris has been drawn by the vacuum. When the door is closed, the motor is turned off. A magnet helps to keep the door in the open position and a retainer helps to keep the door in the closed position.

Accordingly, it is an objective of the present invention to provide an illuminated inlet for a vacuum cleaning system which can be molded and is relatively simple to operate.

It is a further objective of the present invention to provide an inlet for a vacuum cleaning system which turns on the vacuum cleaning system and an illumination light when the door of the inlet is opened and shuts off the vacuum cleaning system when the door of the inlet is closed.

It is yet another objective of the present invention to provide an inlet for a vacuum cleaning system which can be permanently mounted in a wall or cabinet and is relatively inconspicuous.

It is a still further objective of the present invention to provide an inlet for a vacuum cleaning system which enables the door of the inlet to be operated without the use of an individual's hand.

It is still yet a further objective of the present invention to provide an inlet for a vacuum cleaning system which includes a device to maintain the door of the inlet in an open position after it has been opened.

It is still yet a further objective of the present invention to provide an inlet for a vacuum cleaning system which includes a device to maintain the door of the inlet in a closed position after it has been closed.

It is a still further objective of the present invention to provide an inlet for a vacuum cleaning system which enables an air tight seal to be established at the inlet of the vacuum cleaning system after the door of the inlet has been closed.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
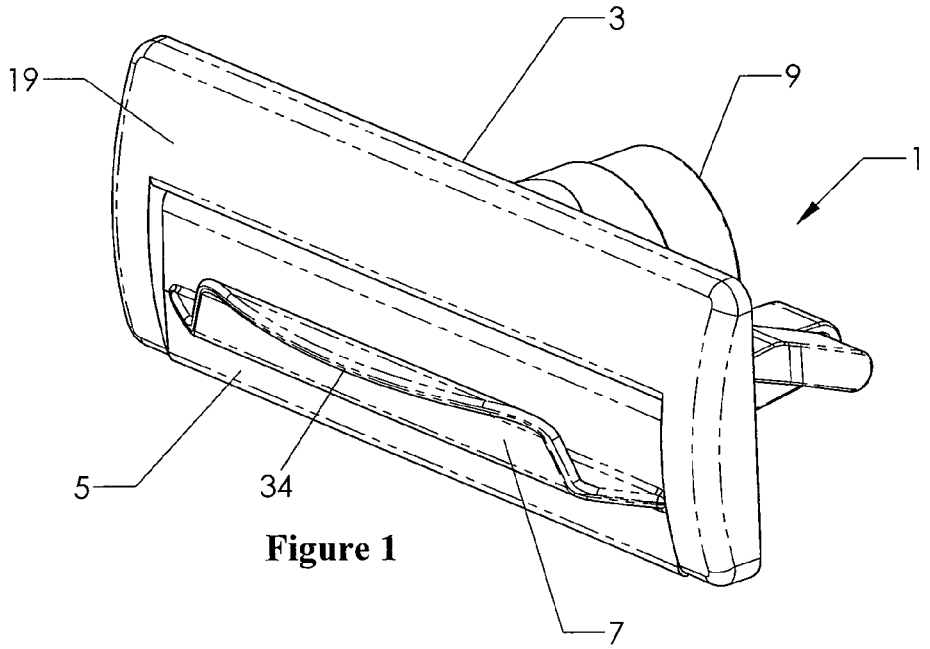
FIG. 1 is a front perspective view of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIGS. 1-25, which are now referenced, illustrate the present invention and the manner in which it is assembled. The present invention is directed to a vacuum system which is preferably, but not necessarily, mounted in a wall of a structure, building, recreational vehicle, or mobile home. The vacuum system includes a housing, a motor, an air filter, a compartment for holding the debris collected by the vacuum system, and a tube connected to an inlet. These elements are preferably made from metal. They can also be made from ABS plastic or a polycarbonate/ABS plastic blend. These elements are not shown. The present invention is directed to an inlet for the vacuum cleaning system.

Figure 25:
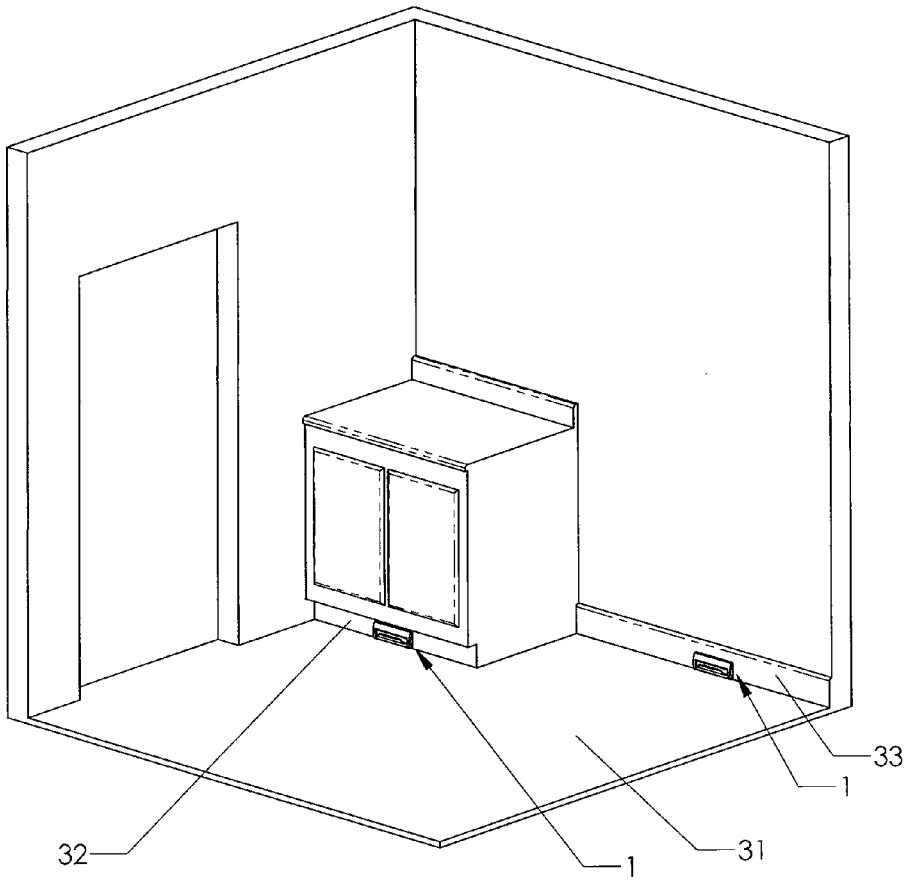
FIG. 25 is an environmental view of the present invention installed in a building.

The preferred embodiment of the present invention is an inlet, mounted in a wall or other structure, for a vacuum cleaning system. This is illustrated in FIG. 25 where an inlet housing or vacuum pan 1 is mounted in the baseboard 33 of a wall or in the kick plate 32 of a cabinet. The baseboard and cabinet are located in a room. The room may be in a building, in a recreational vehicle, or in a mobile home. The vacuum cleaning system is normally used after an individual has cleaned a room. This cleaning process usually comprises sweeping up of debris on the floor of the room into a pile. Without the present invention, the pile of debris would normally be picked up with a dust pan. The use of a dust pan can result in not all of the debris being picked up and removed from the room. The present invention enables the individual to sweep the debris toward the inlet housing 1, open the inlet housing 1, sweep the debris into the inlet housing 1, and have the vacuum cleaning system transport the debris to a container where it can be stored until the individual empties the container and disposes of the debris. The vacuum cleaning system assures that all of the debris that is swept into the inlet housing 1 is removed from the room and deposited into a container where it can be safely stored for later disposal.

Figure 2:
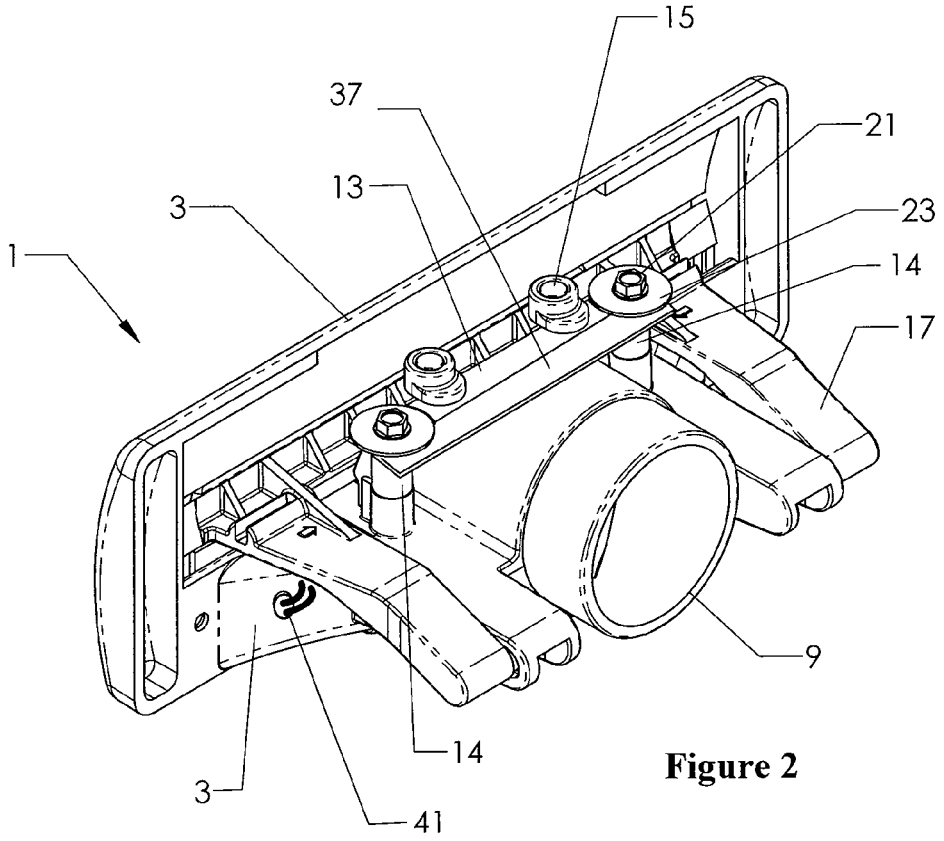
FIG. 2 is a rear perspective view of the present invention.
Figure 3:
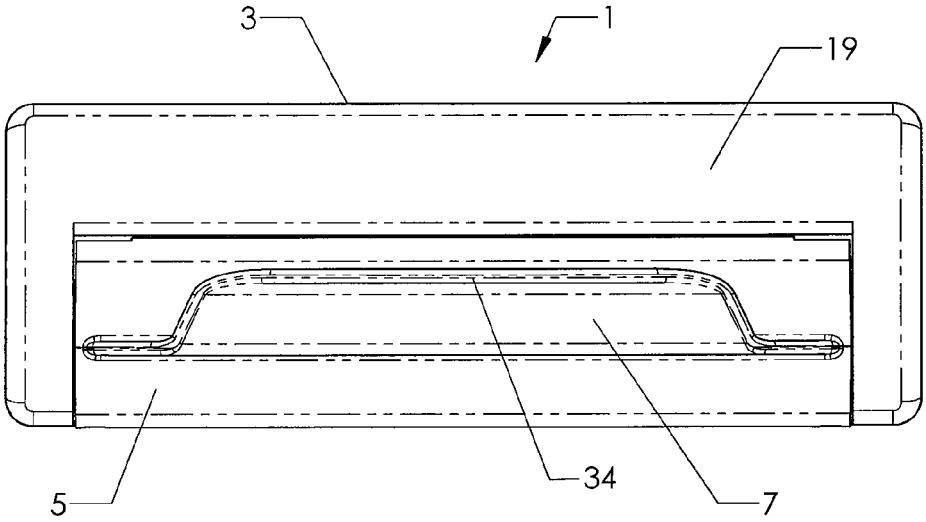
FIG. 3 is a front view in plan of the present invention.
Figure 4:
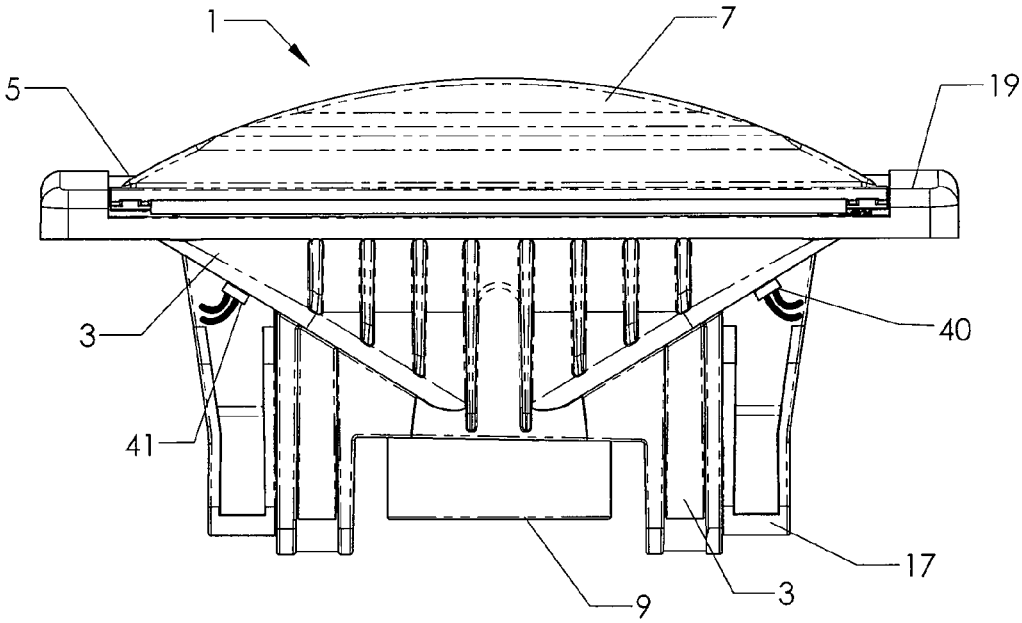
FIG. 4 is a bottom view of the present invention.

The inlet housing 1, as illustrated in FIGS. 1 and 2, a main frame 3, an inlet door 5 and an outlet 9. The outlet 9 can be molded onto the main frame 3 or it can be a separate element which is secured to the main frame 3. The outlet 9 is secured to a tube or flexible hose (not shown) by a fastener or fasteners which are removable (not shown). The tube or flexible hose is connected to the debris collection container (not shown). Thus, the dirt or debris that is placed into the inlet housing 1 is transported to a collection container at a remote location. The dirt or debris is stored in the collection container until it is convenient to remove the dirt or debris therefrom and dispose of it. Therefore an individual need not concern themselves with the immediate need to dispose of the dirt or debris that they have just removed from a room.

The inlet housing 1 is preferably constructed from a thermoplastic material. Other materials, which can be molded, can also be used to form the inlet housing 1. The front of the inlet housing 1 includes a door 5 which has a door actuator 7 secured to or molded thereon and a front wall or bezel 19 (FIGS. 1, 3, 4, 5, and 7). The front wall or bezel 19 includes mounting apertures 10 (FIGS. 6, 8, 9 and 23). Fasteners are inserted through these mounting apertures 10 to secure the front wall or bezel 19 and inlet housing 1 to a surface in a building, a recreational vehicle, or a mobile home. The main frame 3 is secured to the front wall with an air tight connection. In a preferred embodiment, the front wall 19 is molded together with the main frame 3. A non-limiting example of the manner in which the present invention is mounted is illustrated in FIG. 25 wherein the inlet housing 1 is mounted to a baseboard 33 of a wall and to a kick plate 32 of a cabinet.

Figure 5:
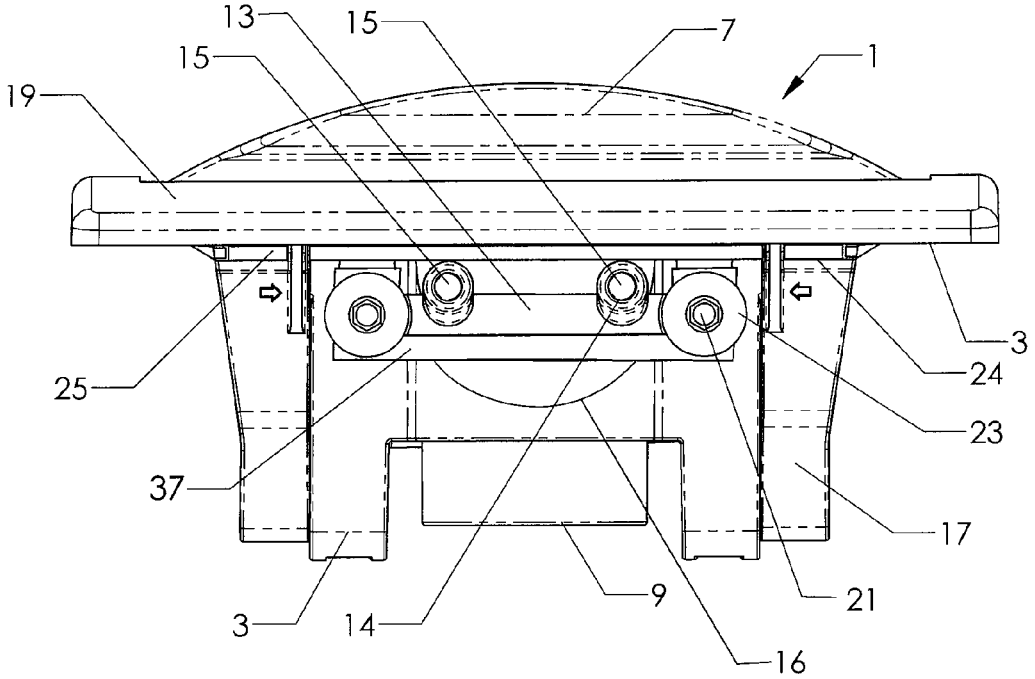
FIG. 5 is a top view of the present invention.
Figure 7:
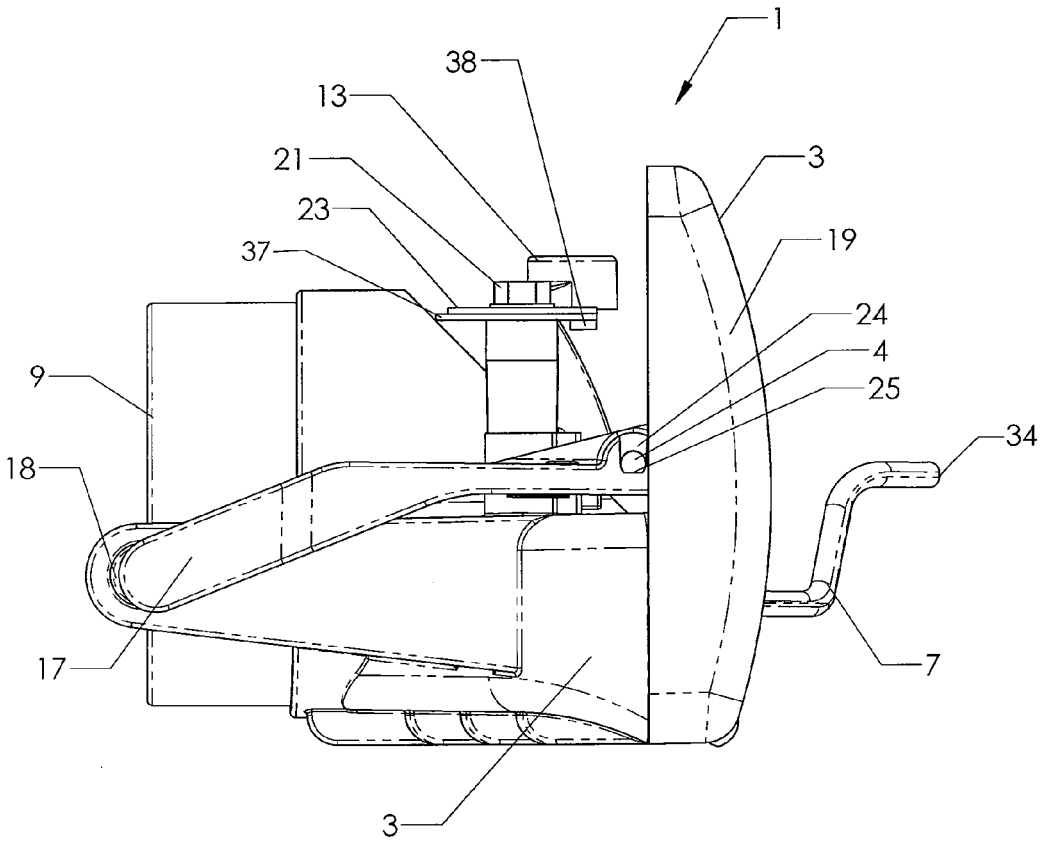
FIG. 7 is a left side view of the present invention.
Figure 9:
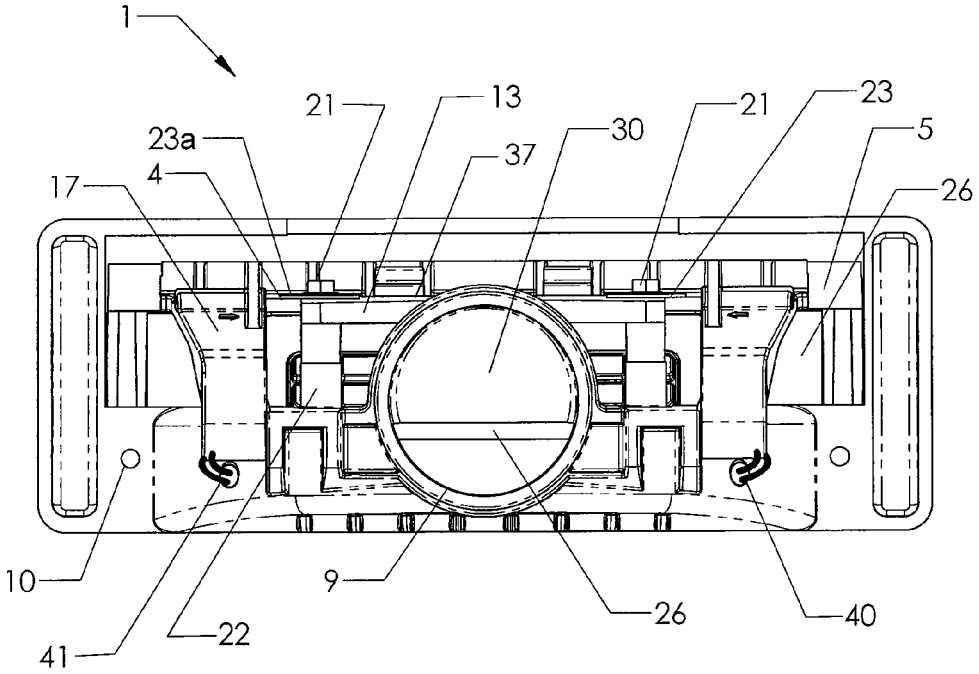
FIG. 9 is a rear view of the present invention with the door open.
Figure 10:
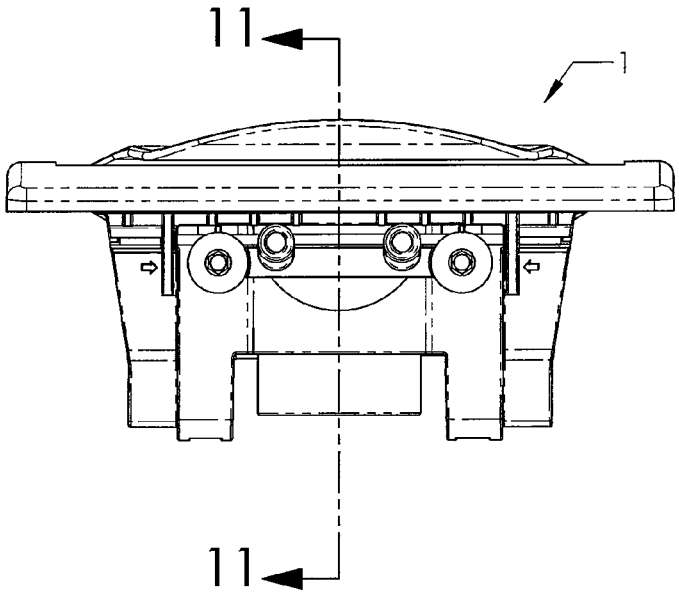
FIG. 10 is a top view of the present invention with the door open.
Figure 23:
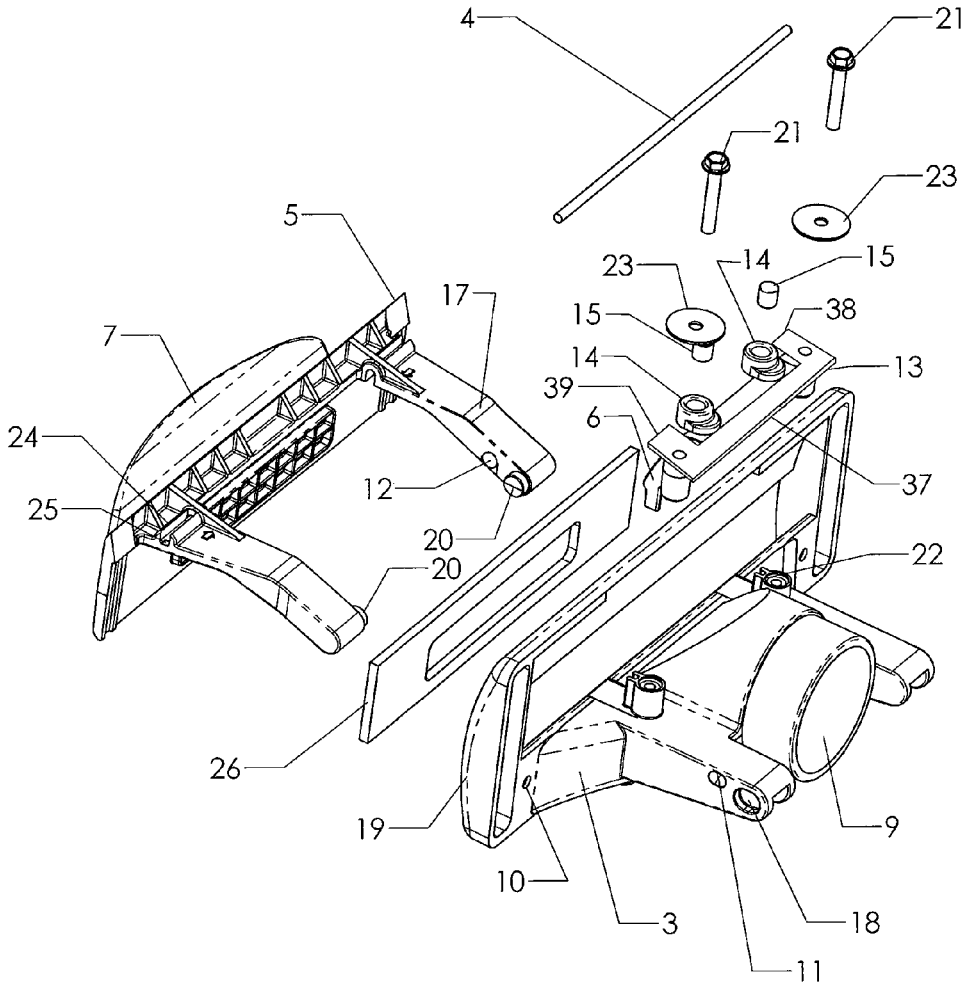
FIG. 23 is an exploded rear perspective view of the present invention.
Figure 24:
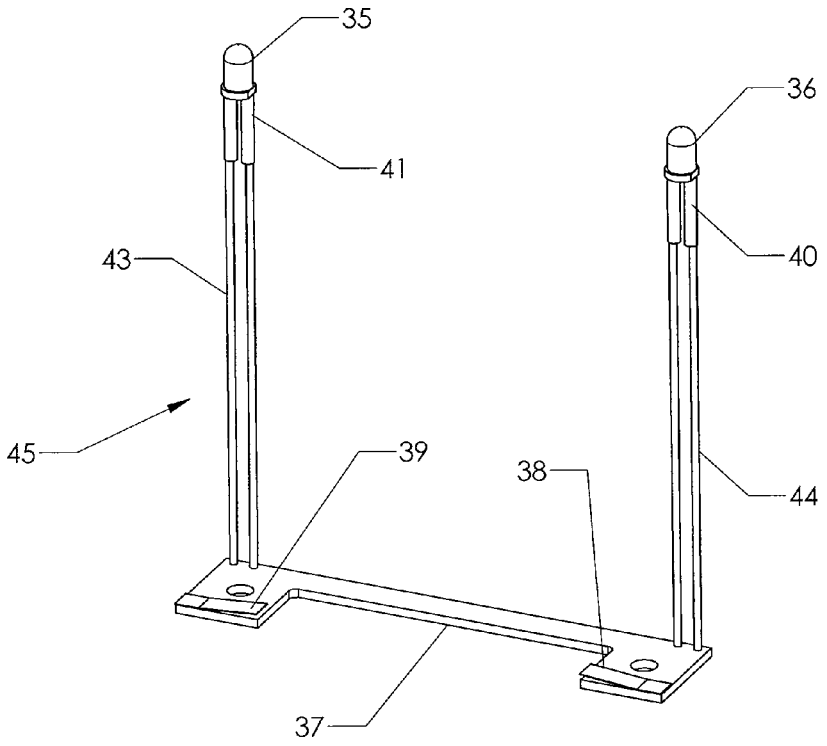
FIG. 24 is a perspective view of the illuminating light assembly.

The door actuator 7 includes a lip 34, (FIGS. 1, 3, 7, 11, 14, 17, and 20). The door actuator 7 is employed by an individual to open the door 5. The opening of the door 5 is normally accomplished by the individual placing their foot beneath the door actuator 7 and raising the door 5 by raising their foot. The door actuator 7 can also be operated by hand, by a broom, or by another object. The door 5 is later closed by the individual placing their foot or other object on the top of the door actuator 7 and pushing the door 5 downwardly to its closed position. Secured to the rear side of the door 5 is a contact rod 4 (FIGS. 7, 9, 11, 12, 17, 18, and 20-23). The contact rod 4 is secured with in the contact rod channels 24 (FIGS. 5, 7, and 23). Lateral movement of the contact rod 4 is prevented by contact rod retainers 25, one of which is illustrated in FIG. 7. There is also another contact rod retainer 25 on the outer end of the other rod channel 24 in FIG. 23 but it is not illustrated. The contact rod 4 is preferably formed from magnetic stainless steel. The contact rod 4 can also be formed from other electrically conductive materials. The contact rod 4 is employed to turn on and off the motor in the vacuum cleaning system. This is accomplished by the contact rod 4 coming into electrical contact with both contacts 23 and being moved away from electrical contact with both contacts 23, which is best illustrated in FIG. 9. The inter action between the contact rod 4 and the contacts 23 acts like a switch and turns on and off the motor (not shown) of the vacuum cleaning system. Another function of the contact rod 4, described herein after in greater detail, is the operation of LED's when the contact rod 4 engages an LED contact plate 37.

Figure 6:
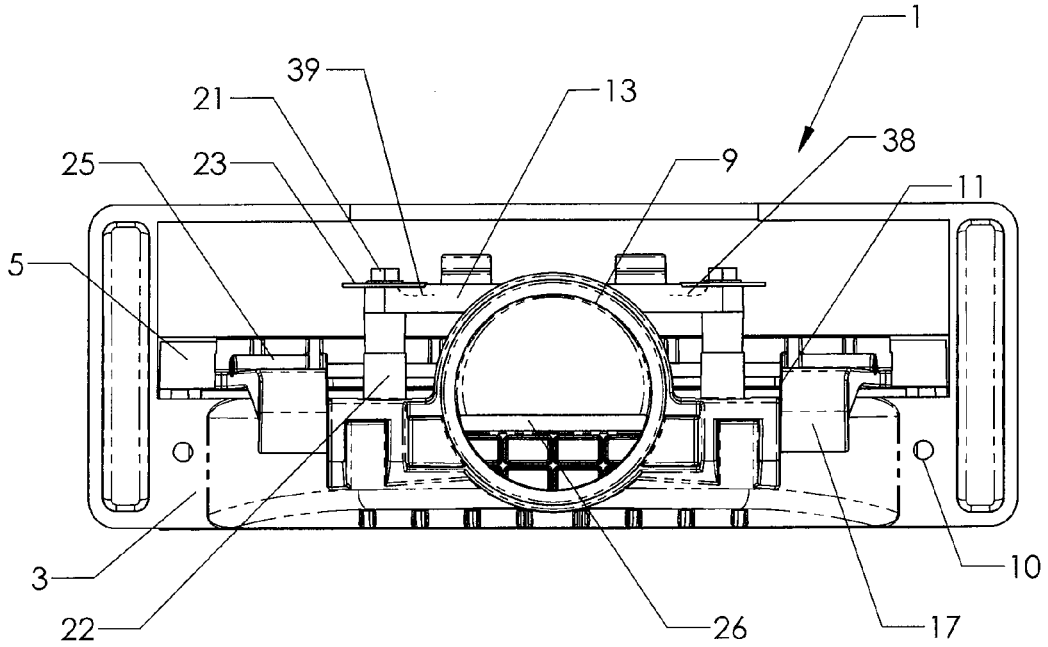
FIG. 6 is a rear view of the present invention.

The main frame 3 includes at least a pair of contacts 23 removably secured at the top of each end of support 13 (FIGS. 1, 6, 22, and 23) by screws 21. Support 13 is removably secured to the screw bosses 22 (FIG. 6). The screws 21 extend from on top of the contacts 23, through the support 13 and into screw bosses 22. The screw bosses 22 are integrally foamed with the main frame 3. This connection enables the inlet housing 1 to be readily disconnected from the electrical system of the vacuum cleaning system for repair or replacement by disconnecting support 13, contacts 23, and screws 21 from the main frame 3. The bezel 19 can then be removed from the mounting surface, if necessary, by removal of the fasteners located in mounting apertures 10. Support 13 includes two door cams 6. One at each end of support 13, FIG. 22. The door cams 6 have cam slots 8, whose function will be described herein after.

Figure 12:
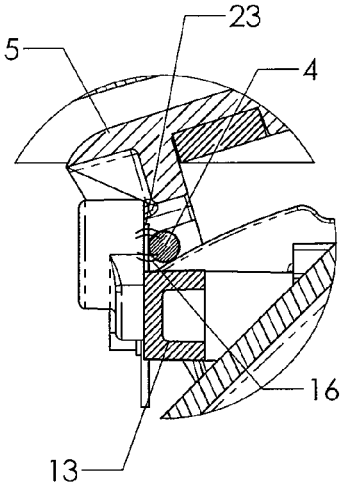
FIG. 12 is a cross sectional view taken within circle 12 in FIG. 11.
Figure 13:
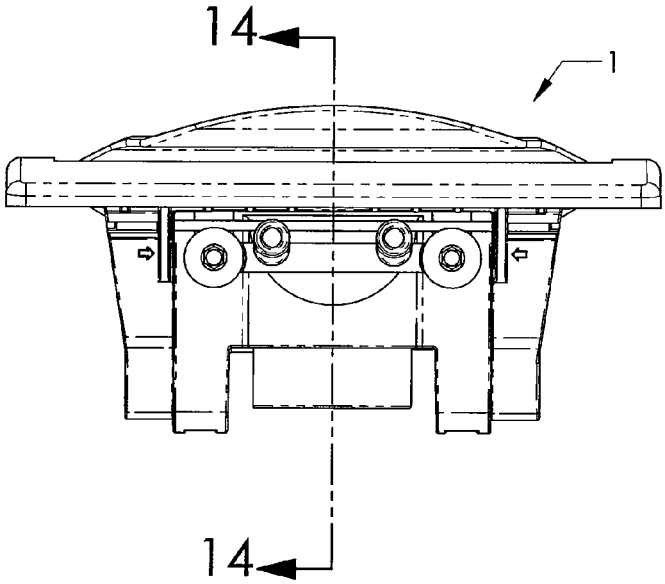
FIG. 13 is a top view of the present invention with the door open.

Support 13 is also provided with a plurality of retainers 14, each retainer 14 secures a magnet 15 therein (FIGS. 2, 5, 22, and 23). The magnets 15 attract contact rod 4 when the contact rod 4 is in the near vicinity of the magnets 15. This occurs when the door 5 is moved to the open position, as illustrated in FIG. 9. FIG. 12 illustrates the magnet field or magnetic flux 16 which extends from the magnet 15. This magnetic flux 16 attracts the metallic contact rod 4 toward the magnet 15. This magnetic attraction also helps to retain the door 5 in its open position and contact rod 4 in contact with the contacts 23.

Electrical wires (not shown) are connected to both electrical contacts 23. A screw 21 (FIGS. 2 and 6) removably secures the electrical wires to each of the contacts 23. These electrical wires are connected to a source of electrical power and the motor of the vacuum cleaning system. When an electrical connection is established between both electrical contacts 23 by the contact rod 4, electrical power is delivered to the motor of the vacuum cleaning system enabling the motor to operate. When the contact rod 4 is removed from contact with both contacts 23, electrical power is shut off from the motor, shutting down the vacuum cleaning system. Therefore, when the door 5 of the inlet is raised to an open position the vacuum cleaning system is turned on and when the door 5 is lowered to a closed position, the vacuum cleaning system is turned off.

The door 5 moves between a closed and an open position by its connection to pivot antis 17 at the rear side of the door (FIG. 2). The pivot aims 17 are secured to the rear of the door at one of their ends and includes a pivot axle 20 (FIG. 23) at an opposite end. The pivot axles 20 are pivotally secured within pivot arm slot 18 (FIGS. 7 and 23). The pivot arm slots 18 are not circular, but rather oval or elliptical. This oval or elliptical shape enables the pivot arms 17 and the door 5, connected thereto, to move forward and backwards with respect to the front of the inlet housing 1. In other words, the door 5 can move toward and away from the front wall 19. Each of the pivot arms 17 also have the rod channel 24 and rod retainer 25 mounted thereon, FIGS. 7 and 23.

Door 5 is illustrated in its fully closed position in FIGS. 3, 4, 5, 6, 7, 19, 20, and 21. In this position the bottom edge of door 5 is substantially in alignment with the bottom edge of bezel 19. Door 5 also has a seal 26 on the rear side thereof, FIGS. 14, 15, 17, 18, 20 and 21. The seal 26 is preferably air tight and seals against the rear of door 5 (FIG. 23). The relationship between the door 5 and the main frame 3, as the door 5 moves from a fully open position to a fully closed position, is illustrated in FIGS. 11, 12, 14, 15, 17, 18, 20, and 21.

Figure 8:
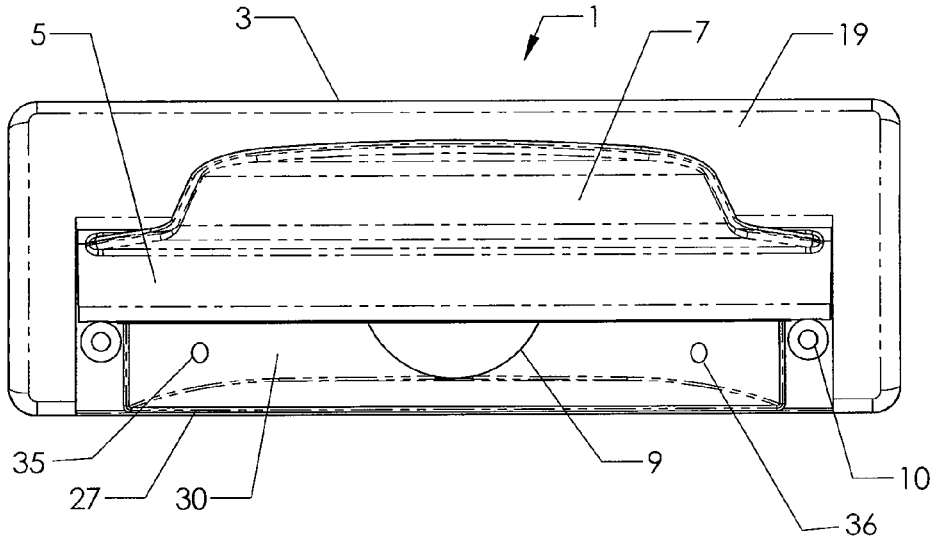
FIG. 8 is a front view in plan of the present invention with the door open.
Figure 11:
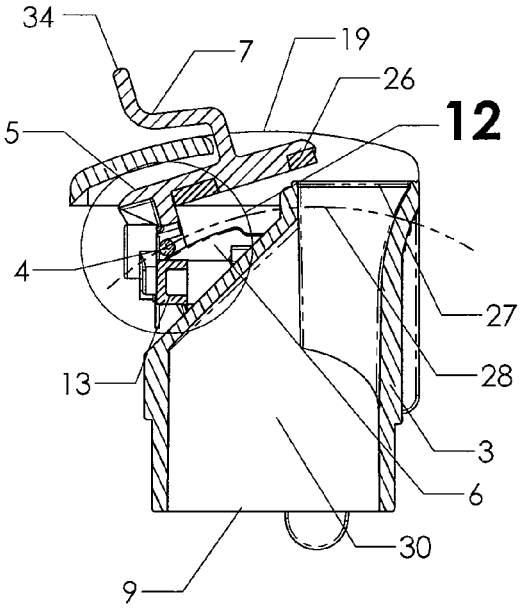
FIG. 11 is a cross sectional view taken along line 11-11 in FIG. 10.

In FIGS. 8, 11 and 12 the door 5 is in its fully open position. The door is completely removed from the opening of chamber 30. This enables all dirt and/or debris to be drawn into the vacuum cleaning system through chamber 30 and outlet port 9 of the present invention. Lighting elements are provided by first LED 35 and second LED 36 mounted within the chamber 30. The LED's operate when the door 5 is open by use of an LED contact plate 37, shown in FIG. 23, which is fastened to the support 13. The LED contact plate 37 having a first contact 38 and a second contact 39 (FIG. 6) that are electrically coupled together to form a low voltage conduit upon engagement with contact rod 4. The rear of LEDs 35 & 36, depicted by structure 40 & 41 respectfully, extend through the sidewall of main frame 3 allowing for ease of assembly and servicing. Low voltage wiring 43 and 44 between the LED's 35 & 36 and the contact plate 37 are positioned along the back of the sidewall eliminating the need for conduit securement. Further illustrated in FIG. 24, set forth is the lighting element assembly 45 depicting the LED contact plate 37 having contacts 38 and 39 strategically positioned to engage the contract rod when the door is in its fully open position. The contact plate 37 is electrically coupled to the LED's 35 & 36 by wire 34 and 44 respectively.

The magnets 15 attract and retain contact rod 4. The upper surface of door actuator 7 is proximate the opening in bezel 19. The arc path through which contact rod 4 travels between the door's open and closed position is illustrated as 28.

Figure 14:
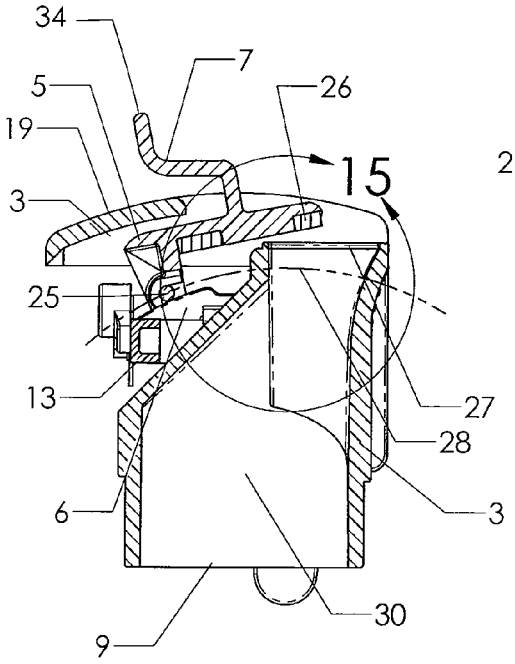
FIG. 14 is a cross sectional view taken along line 14-14 in FIG. 13.
Figure 15:
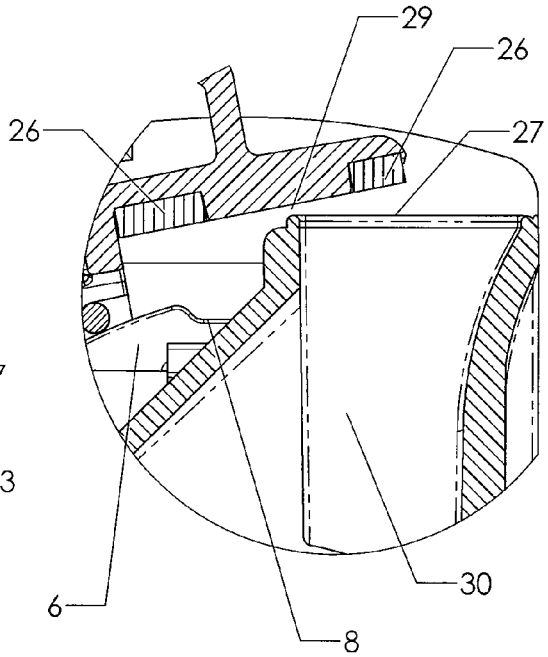
FIG. 15 is a cross sectional view taken within circle 15 in FIG. 14.
Figure 16:
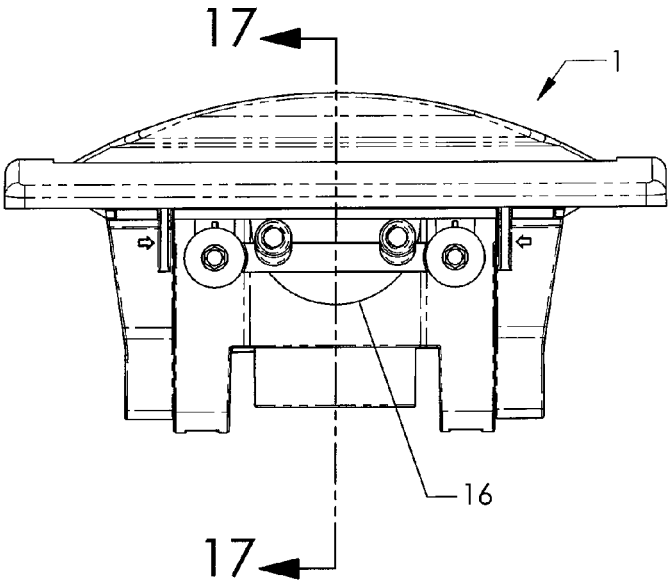
FIG. 16 is a top view of the present invention with the door open.

In FIGS. 14 and 15 the door 5 is moved toward its closed position. The contact rod 4 is no longer being attracted by magnets 15 nor is the contact rod 4 in contact with contacts 23. The contact rod 4 is seen as moving upwardly, toward the right in FIG. 14 along path 28. Since FIG. 14 is a cross section of the present invention which has been rotated 90 degrees, the actual path of contact rod 4 is downward and outward. In these Figs. the door 5 partially covers the opening of chamber 30. Seal ring 27 is formed on an inlet of chamber 30, as illustrated in FIGS. 11, 14, 15, 17, 18, 20 and 21. In FIG. 15 there is a clearance 29 between the door 5 and the seal ring 27, so that the seal 26 will not drag on the seal ring 27 while the door moves between the open and closed positions.

Figure 17:
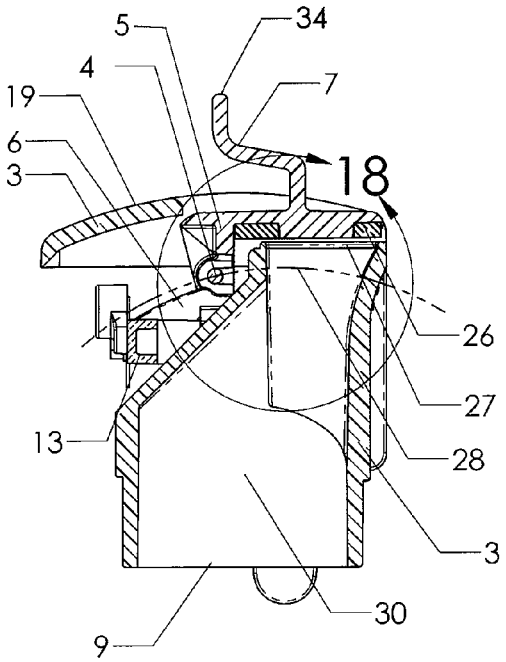
FIG. 17 is a cross sectional view taken along line 17-17 in FIG. 16.
Figure 18:
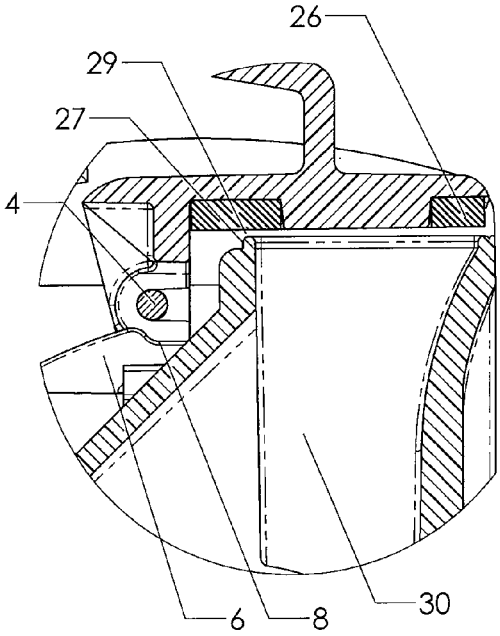
FIG. 18 is a cross sectional view taken within circle 18 in FIG. 17.
Figure 19:
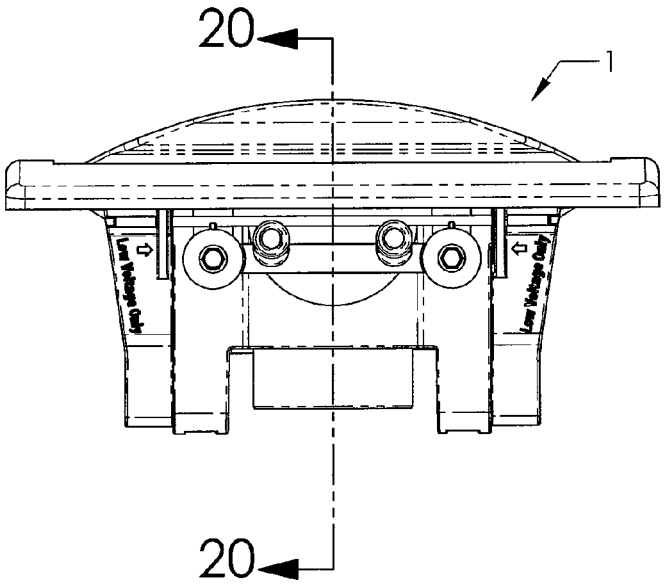
FIG. 19 is a top view of the present invention with the door open.

In FIGS. 17 and 18 the door 5 is moved to its lowermost position on the bezel 19, but not to its fully closed position. The contact rod 4 travels further along path 28 moving upwardly, toward the right in FIG. 17 along path 28. Since FIG. 17 is a cross section of the present invention which has been rotated 90 degrees, the actual path of contact rod 4 is downward and outward. Contact rod 4 is now aligned with, but not within cam slot 8. Cam slot 8 is located in door cam 6, as seen in FIGS. 17, 18, 20 and 21. Cam slot 8 helps to retain contact rod 4 in position when the door 5 is in the fully closed position. In this position, seal 26 is adjacent the seal ring 27 but not in airtight contact with the seal ring 27.

Figure 20:
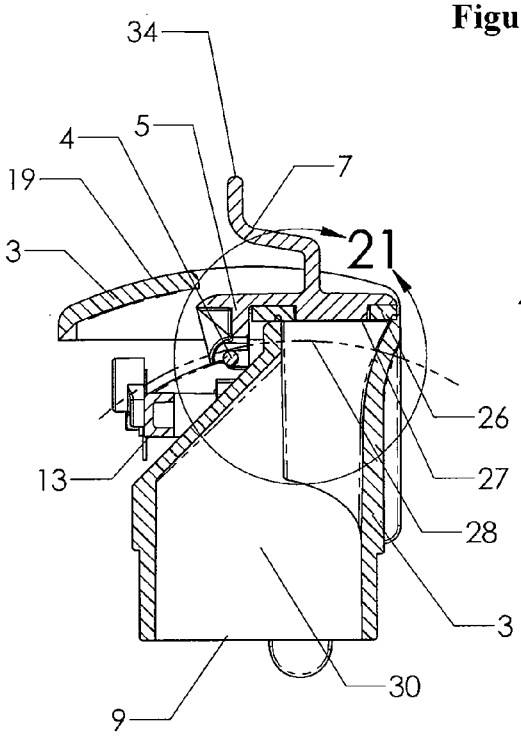
FIG. 20 is a cross sectional view taken along line 20-20 in FIG. 19.
Figure 21:
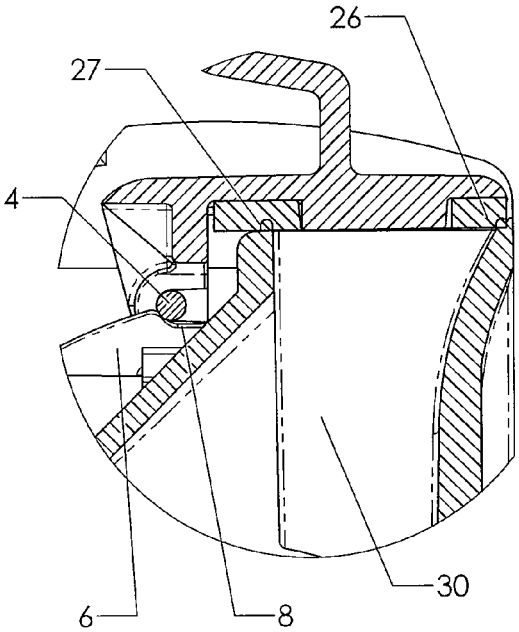
FIG. 21 is a cross sectional view taken within circle 21 in FIG. 20.
Figure 22:
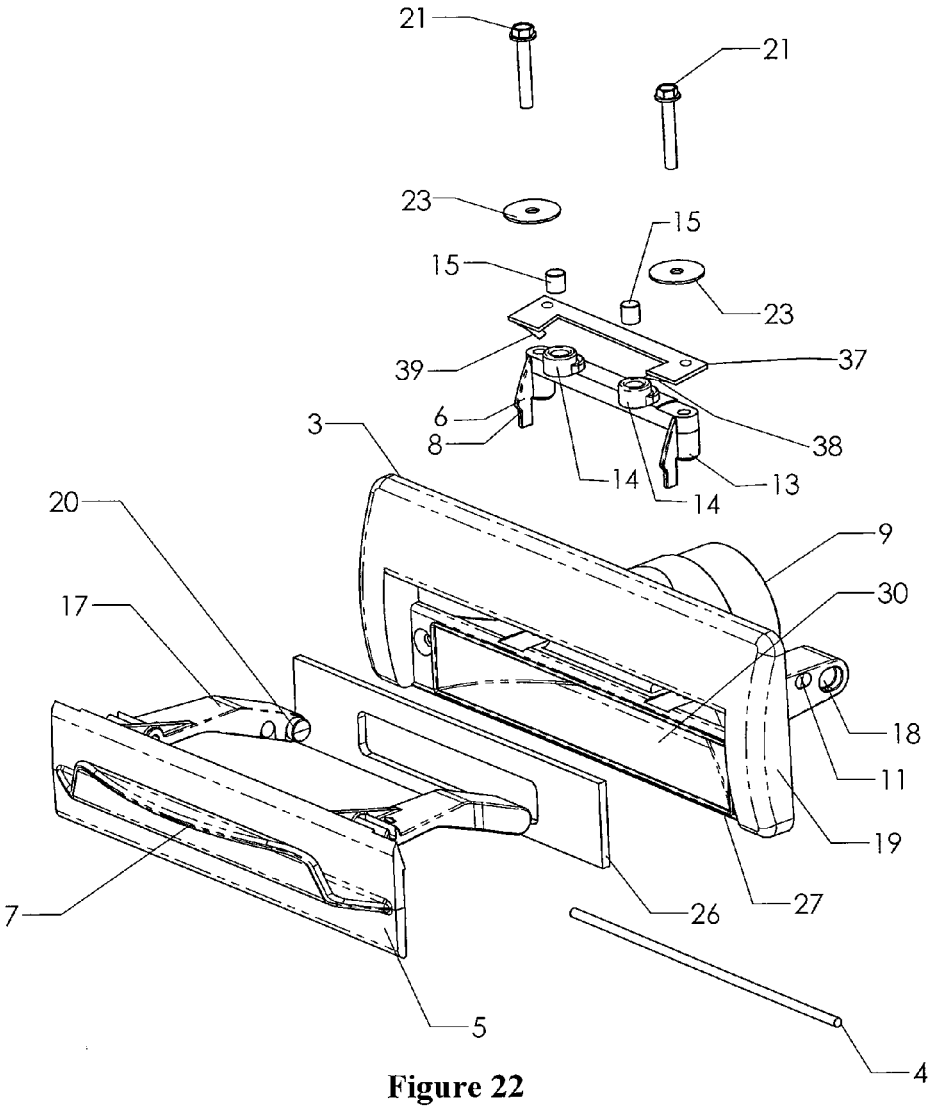
FIG. 22 is an exploded front perspective view of the present invention.

Finally, in FIGS. 20 and 21 the door 5 is moved to its lowermost and fully closed position on the bezel 19. The contact rod 4 travels further along path 28 moving upwardly, toward the right in FIG. 20 along path 28. Since FIG. 20 is a cross section of the present invention which has been rotated 90 degrees, the actual path of contact rod 4 is downward and outward. Contact rod 4 is now within cam slot 8. Cam slot 8 is located on door cam 6, as seen in FIGS. 17, 18, 20, and 21. Cam slot 8 helps to retain contact rod 4 in position when the door 5 is in the fully closed position. A projection boss 12 is formed on an interior portion of each pivot arm 17, as seen in FIG. 23. A retainer detent 11 is formed on the main frame 3, adjacent each pivot arm slot 18. Frictional contact between the projection boss 12 and the retainer detent 11 assists in holding the door 5 in its closed position. The plastic elasticity of each of the projection bosses 12 permits the bosses to move into and out of the retainer detents 11. This relationship enables the door 5 to be held in its full closed position and easily be moved between its closed position and its open position. In the fully closed position of door 5, seal 26 is firmly against the seal ring 27 and in airtight contact with the seal ring 27. As can been seen in FIG. 21, the seal ring 27 partially penetrates into seal 26 to form an airtight seal therewith and completely seal chamber 30. Once the door 5 is in its fully closed position the retainer detents 11 on the projection bosses 12 frictional engage the pivot arms 17 and hold the door 5 in its closed position.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An illuminated inlet for a vacuum cleaning system comprising:

a main frame having a vacuum chamber therein and two spaced apart pivot arm slots;

a front wall secured to said main frame by an air tight connection between said front wall and said main frame, said front wall including a door having two pivot arms extending from a rear portion of said door and rotatably coupled to said pivot arm slots, said door pivoting between a closed position and an open position;

said closed position of said door preventing any material from entering said inlet and said open position of said door permitting material to be introduced into said inlet;

a contact rod secured between said at least two pivot arms, said contact rod coupling a first electrical contact with a second electrical contact when said door is in an open position causing operation of a vacuum operatively associated with said vacuum chamber;

a least one lighting element mounted within said vacuum chamber and coupled to said first and second electrical contact when said door is in an open position causing illumination of the lighting element during operation of the vacuum;

an outlet, said outlet being secured to said main frame and being constructed and arranged to be connected to a vacuum cleaning system; whereby a motor of a vacuum cleaning system and said lightening is turned on or off when the contact rod establishes an electrical connection between the at least two contacts allowing ingestion of debris during operation with the entry to the vacuum chamber illuminated.

2. The illuminated inlet for a vacuum cleaning system of claim 1 wherein said door includes a door actuator mounted on a front surface of said door, said door actuator including a lip, said lip being constructed and arranged to open and close the door, said lip also being constructed and arranged to be operated by an individual without the individual using their hands.

3. The illuminated inlet for a vacuum cleaning system of claim 1 wherein said pivot arm slot is constructed and arranged to allow a pivot axle to move toward and away from said front wall.

4. The illuminated inlet for a vacuum cleaning system of claim 1 including a rod channel on an upper surface of each of said at least two pivot arms, said contact rod being secured between said at least two pivot arms by being mounted in said rod channels.

5. The illuminated inlet for a vacuum cleaning system of claim 4 wherein each said rod channel includes a contact rod retainer, said contact rod retainers being constructed and arranged to prevent movement of each of the ends of said contact rod outside of each of said rod channels.

6. The illuminated inlet for a vacuum cleaning system of claim 1 including a seal mounted on a rear surface of said door; said main frame including a chamber therein, said chamber providing a fluid connection between a front of said main frame and said outlet; and an inlet on one end of said chamber, said inlet including a seal ring secured thereto, said seal on said rear surface of said door engaging said seal ring on said chamber, whereby an air tight seal is provided by said seal at said inlet of said chamber when said door is closed as a result of a vacuum in said chamber.

7. The illuminated inlet for a vacuum cleaning system of claim 1 wherein said main frame includes at least one projection boss secured thereon, said at least one projection boss includes a retainer projection secured thereto, said retainer frictionally engaging one of said at least two pivot arms when said door is in said closed position, whereby said retainer projection assists in maintaining said door in said closed position.

8. The illuminated inlet for a vacuum cleaning system of claim 1 including at least one magnet for coupling to said contact rod to maintain said door in an open position.

9. The illuminated inlet for a vacuum cleaning system of claim 1 wherein said lighting element is at least one LED positioned within said vacuum chamber to illuminate the area directly in front of the front wall while the door is in an open position.

10. The illuminated inlet for a vacuum cleaning system of claim 1 wherein said lighting element is further defined as a first LED positioned along one side of said vacuum chamber and a second LED positioned along an opposite side of said vacuum chamber for illuminating the area directly in front of the front wall while the door is in an open position.

* * * * *